US006416693B1

(12) United States Patent
Lockwood

(10) Patent No.: US 6,416,693 B1
(45) Date of Patent: Jul. 9, 2002

(54) METHOD OF STRENGTHENING AN EXISTING REINFORCED CONCRETE MEMBER

(76) Inventor: William D. Lockwood, 3100 Research Blvd., P.O. Box 20266, Dayton, OH (US) 45420

( * ) Notice: Subject to any disclaimer, the term of this patent is extended or adjusted under 35 U.S.C. 154(b) by 0 days.

This patent is subject to a terminal disclaimer.

(21) Appl. No.: 09/536,704

(22) Filed: Mar. 28, 2000

Related U.S. Application Data

(63) Continuation-in-part of application No. 09/290,654, filed on Apr. 12, 1999, now abandoned, which is a continuation-in-part of application No. 08/886,481, filed on Jul. 1, 1997, now Pat. No. 5,894,003

(60) Provisional application No. 60/020,921.

(51) Int. Cl.[7] ..... B32B 35/00; E04B 1/16

(52) U.S. Cl. ..... 264/36.19; 264/35; 264/36.2; 264/138; 264/228; 264/229; 156/94; 156/98

(58) Field of Search ..... 264/35, 36.18, 264/36.19, 36.2, 228, 229, 138; 156/94, 98

(56) References Cited

U.S. PATENT DOCUMENTS

| | | | | |
|---|---|---|---|---|
| 513,794 A | | 1/1894 | Lee | |
| 1,605,197 A | * | 11/1926 | Anfield | 264/138 |
| 4,147,009 A | | 4/1979 | Watry | 264/228 |
| 4,574,545 A | | 3/1986 | Reigstad et al. | 52/223 R |
| 4,615,163 A | | 10/1986 | Curtis et al. | 52/730 |
| 4,646,493 A | | 3/1987 | Grossman | 52/223 R |
| 4,700,516 A | | 10/1987 | Grossman | 52/223 R |
| 5,115,622 A | | 5/1992 | Ammann et al. | 52/741 |
| 5,373,675 A | | 12/1994 | Ellison, Jr. | 52/320 |
| 5,565,257 A | | 10/1996 | Tingley | 428/114 |

FOREIGN PATENT DOCUMENTS

| | | |
|---|---|---|
| FR | 2.070.942 | 12/1969 |
| FR | 2.562.927 | 4/1984 |

OTHER PUBLICATIONS

"Strengthening Bridge Slabs With Grouted Reinforcement" published in Jan. 1949 issue of "Journal of the American Concrete Institute".

* cited by examiner

*Primary Examiner*—Jan H. Silbaugh
*Assistant Examiner*—Michael I. Poe
(74) *Attorney, Agent, or Firm*—Jacox, Meckstroth & Jenkins

(57) ABSTRACT

Parallel spaced shallow grooves are cut within the surface of an existing reinforced concrete member in the direction of bending and at locations where existing tensile reinforcing is inadequate. A curable polymer adhesive resin, such as an epoxy resin, is inserted into each groove and an elongated fiber reinforcing element, such as a composite rod with continuous carbon fibers, is positioned within each groove, substantially filling the groove, so that the minimum volume adhesive resin surrounds the reinforcing element. The adhesive resin within each groove is formed flush with the surface and allowed to cure to bond each reinforcing element to the concrete defining the groove. The grooves and reinforcing elements extend within the top surface of a concrete slab across a beam or support for the slab, extend within the bottom surface of the slab at least fifty percent of the distance between adjacent supports for the slab, or within a vertical surface of a concrete or masonry wall or column.

15 Claims, 2 Drawing Sheets

METHOD OF STRENGTHENING AN EXISTING REINFORCED CONCRETE MEMBER

RELATED APPLICATION

This application is a continuation-in-part of application Ser. No. 09/290,654, filed Apr. 12, 1999, now abandoned, which is a continuation-in-part of application Ser. No. 08/886,481, filed Jul. 1, 1997, U.S. Pat. No. 5,894,003, which claims the benefit of the filing date of Jul. 1, 1996 of provisional application Ser. No. 60/020,921.

BACKGROUND OF THE INVENTION

In existing reinforced concrete elements or members such as concrete slabs, beams, columns and walls, it is sometimes desirable to strengthen the member for one or more reasons. For example, the applied loading requirements may exceed the original design values for the member, or the load carrying capacity of the member may have been reduced due to deterioration, or the member may require increased stiffness for less deflection. The member may also require lower working stresses to reduce fatigue, or may require upgrading to withstand higher seismic and/or blast loading.

One form of strengthening existing reinforced concrete elements or members is by laminating or bonding a mat or strip of composite material with carbon or glass fibers to the surface of the concrete member where bending occurs. However, it is undesirable for the composite mat or strip to be exposed to the weather and/or to traffic such as on the top surface of a concrete bridge slab. For example, if water seeps between the composite mat or strip and the concrete surface, it is possible for the mat or strip to delaminate from the concrete surface if the water freezes. It is also necessary to prepare the concrete surface in order to obtain a good bond of the reinforcing mat or strip to the concrete surface.

Another form of strengthening a reinforced concrete horizontal deck is by cutting or forming parallel grooves or cavities within the surface of the concrete deck and embedding steel reinforcing rods or "rebars" within the grooves or cavities with mortar or concrete, for example, as disclosed in U.S. Pat. No. 4,574,545 and as described in an article entitled "Strengthening Bridge Slabs with Grouted Reinforcement" published in the January 1949 issue of the "Journal of The American Concrete Institute". It is also known to reinforce a stone slab with a series of cables embedded in parallel spaced grooves formed or cut in a back surface of the stone slab, with the cables being embedded in a mixture of sand and epoxy resin which filled the grooves, as disclosed in French Patent No. 2 562 927. Wood beams and wood planks have also been reinforced with a polyester rod or rods which are glued within a groove or grooves formed within a surface of the wood beam or plank, for example, as disclosed in U.S. Pat. Nos. 5,565,257 and No. 4,615,163.

SUMMARY OF THE INVENTION

The present invention is directed to an improved method for strengthening existing reinforced concrete elements or members such as concrete slabs, beams, columns and walls after it is determined where the existing tensile reinforcing rods or bars in the concrete are inadequate. In accordance with the invention, one or more parallel spaced shallow grooves are cut within the surface of the existing reinforced concrete element or member in the direction of bending of the member and in the area of inadequate tensile reinforcing.

A composite fiber reinforcing element, such as a composite rod or element with continuous carbon fibers, is positioned within each groove after a polymer adhesive resin or epoxy resin is inserted into the groove. The reinforcing rod is twisted or rotated or shifted so that the adhesive resin completely surrounds the reinforcing element. The polymer adhesive resin is formed flush with the surface of the concrete member and allowed to cure to bond each element or rod to the concrete defining the corresponding groove. Each groove and corresponding reinforcing element or rod extend within the top surface of a concrete slab across a support for the slab and extend within the bottom surface of the slab at least fifty percent of the distance between adjacent supports for the slab. Each groove and reinforcing element may also extend within a vertical surface of a masonry or concrete wall in the direction of bending of the wall.

The method of the invention eliminates surface preparation of an existing concrete member, a step that is normally required to bond a strip or mat to the element or to connect a steel rebar within a concrete groove. The method also provides for locating the supplemental reinforcing element or rod just below the concrete surface, thereby protecting the reinforcing element or rod which is completely encased within the polymer adhesive or epoxy resin. The fiber reinforcing element is also located adjacent or just under the surface of the concrete where the element is the most effective. Also, the resin within the grooves is protected from heat due to fire and is less likely to soften and lose strength, in comparison to the exposure of the resin which is used to attach strips or plates to the concrete surface.

The invention further provides for concentrating the reinforcing elements at the critical stress locations, and the use of a composite element with continuous fibers for the supplemental reinforcing provides for efficient use of the supplemental reinforcing adjacent the surface of the concrete element. The supplemental reinforcing rods within the grooves may also be pre-stressed before adhesively bonding to the concrete, and the concrete element may be deflected in a direction opposite to the direction of deflection caused by loading of the concrete element to provide for an initial pre-stressing of the reinforcing rod or element.

Other features and advantages of the invention will be apparent from the following description, the accompanying drawings and the appended claims.

DESCRIPTION OF THE PREFERRED EMBODIMENTS

Figure 1:
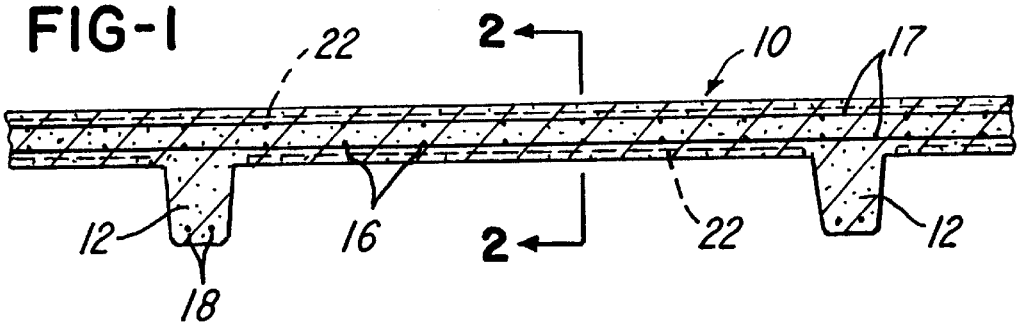
FIG. 1 is a fragmentary section of an existing reinforced concrete slab which has been strengthened in accordance with the method of the invention.

FIG. 1 illustrates an existing reinforced concrete member or slab 10 which includes a set of integrally cast and parallel spaced concrete beams 12. The slab 10 was originally reinforced by embedded steel bars or rods 16 and 17 (FIG. 2) which extend within the concrete at 90° to form layers of steel reinforcing grids within the concrete. The bottom portion of the beams 12 may also have embedded steel reinforcing bars or rods 18 which are spaced and positioned along with the rods 16 and 17 within the concrete forms before the slab 10 is poured with concrete. After an extended period of use of the concrete slab 10, it sometimes becomes necessary to strengthen the slab for one or more of the reasons mentioned above and in areas where the existing steel reinforcing rods or bars are inadequate for tensile reinforcing of the slab.

Figure 2:
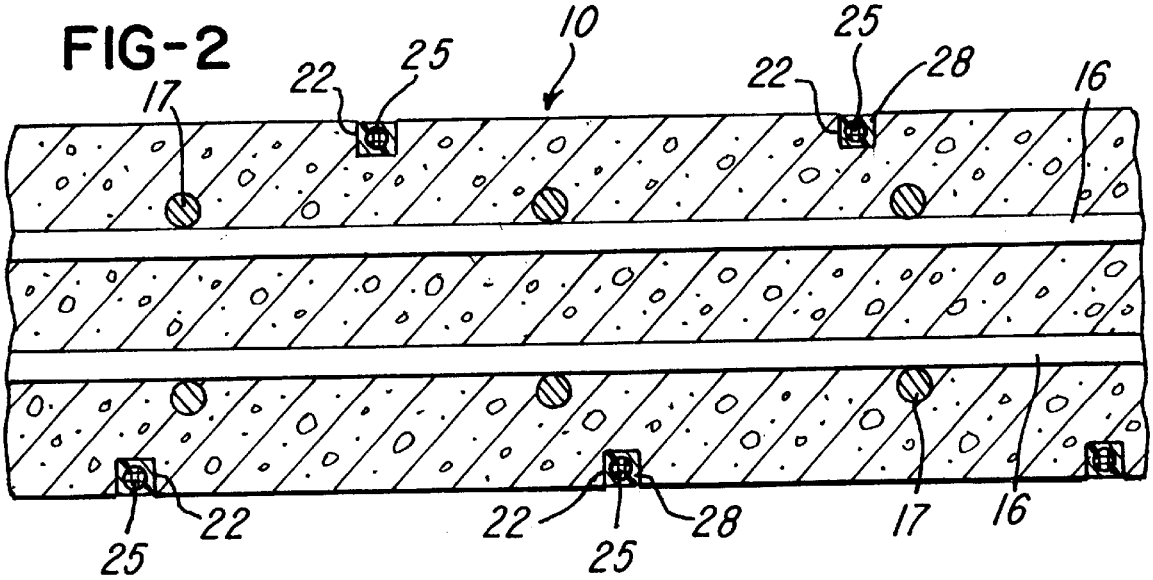
FIG. 2 is an enlarged fragmentary section of the concrete slab, as taken generally on the line 2—2 of FIG. 1.
Figure 3:
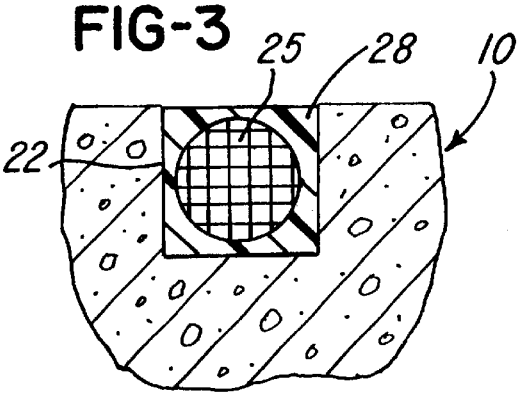
FIG. 3 is an enlarged fragmentary section of a supplemental reinforcing element or rod bonded within a groove with a polymer adhesive resin, as shown in FIG. 2.

In accordance with the present invention, a series of parallel spaced elongated grooves 22 are cut within the top surface and/or bottom surface of the slab 10, as shown in FIG. 2, with a suitable concrete saw. For example, each groove 22 may have a width and depth of ⅜", but grooves of other sizes may also be used. Each groove 22 receives a supplemental composite reinforcing element or rod 25 which is secured within the groove by a curable polymer adhesive resin 28 such as an epoxy resin so that the rod 25 is secured or bonded around its entire outer surface to the concrete surfaces forming the groove 22. Preferably, each rod 25 is a non-metallic composite rod having longitudinally extending continuous carbon fibers to provide the rod with a very high tensile strength. As an example, a rod 25 having a diameter of ¼" may be used in the ⅜" groove, but preferably, the element or rod fills at least fifty percent of the groove and occupies at least eighty percent of the groove width, as shown in FIG. 3. Each composite rod 25 may also have a roughened or deformed outer surface to increase the bond with the polymer adhesive resin and concrete.

As shown in FIG. 1, the grooves 22 and corresponding rods 25 extend continuously within the top surface of the slab 10 across the beams 12 and in areas where the existing reinforcing provided by the steel bars 16 and 17, is inadequate. The grooves 22 and corresponding rods 25 within the bottom surface of the slab 10 extend at least fifty percent of the distance between adjacent support beams 12 and preferably have opposite ends close to the beams 12, as shown in FIG. 1. In the bottom surface of the slab 10, the rods 25 are retained within the corresponding grooves 22 by an epoxy resin 28 which is capable of holding the supplemental reinforcing rods 25 within their corresponding grooves until the resin cures and hardens. The resin is also formed flush with the concrete surface with a suitable putty knife before the resin cures and hardens to form the positive bond of the reinforcing rod 25 to the concrete slab adjacent the surface.

Figure 4:
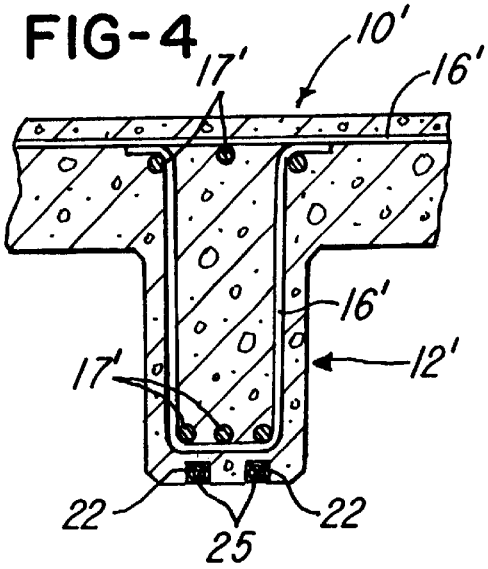
FIG. 4 is a fragmentary section of an existing reinforced concrete beam which has been strengthened by the method of the invention.

Referring to FIG. 4, a modified existing concrete slab 10' has embedded steel reinforcing bars or rods 16' and 17' which extend into an integrally cast beam 12'. To provide the beam 12' with supplemental tensile reinforcing and to strengthen the slab 10' and beam 12', one or more grooves 22 are cut within the bottom surface of the beam 12' and receive corresponding reinforcing rods 25 each surrounded by a polymer adhesive resin or epoxy resin 28. The bonded rods 25 substantially increase the bottom tensile strength of the beam 12', and the grooves 22 may also be easily formed within the bottom surface of the beam.

Figure 5:
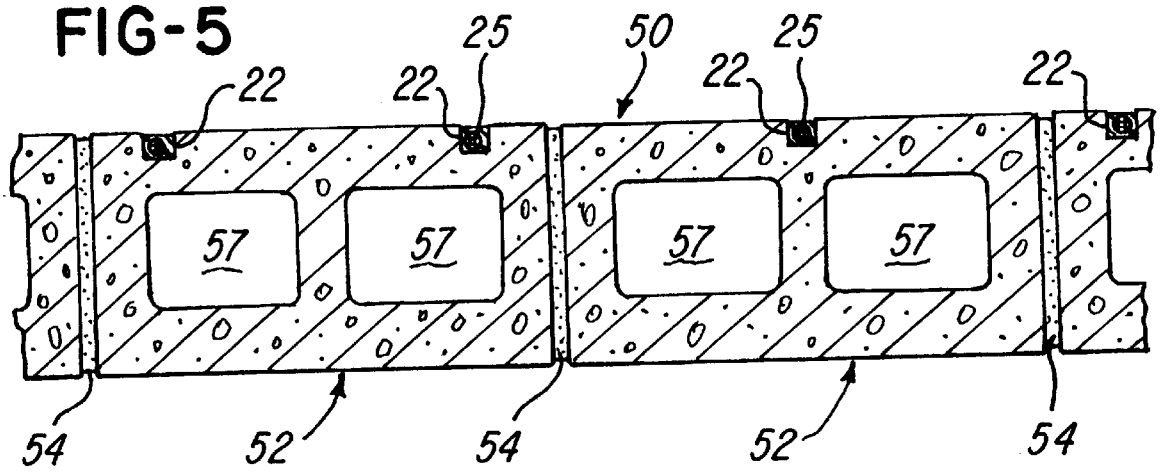
FIG. 5 is a fragmentary section of a masonry or concrete block wall which has been strengthened in accordance with the invention.

FIG. 5 illustrates using the method of the invention for strengthening an existing solid concrete or masonry wall 50, for example, in the form of modular concrete blocks 52 joined together by joint layers of mortar 54. The blocks 52 have may be solid or have internal cavities 57 which are filled with concrete with reinforced with steel rods (not shown) when the wall is constructed. In accordance with the present invention, the vertical concrete wall 50 is strengthened by forming a series of parallel spaced grooves 22 in the outer surface and/or inner surface of the blocks 52. The grooves may be vertical or horizontal or at an angle and extend across the mortar joints 54. Each groove 22 is filled with a composite fiber reinforcing element or carbon fiber rod 25 and bonded to the concrete blocks by a polymer adhesive resin or epoxy resin 28 within each groove 22, as shown in FIG. 2. As mentioned above, the grooves 22 and supplemental reinforcing elements or rods 25 are located in the area where the wall tends to bow or bend and where tensile reinforcing is necessary or desirable.

Figure 6:
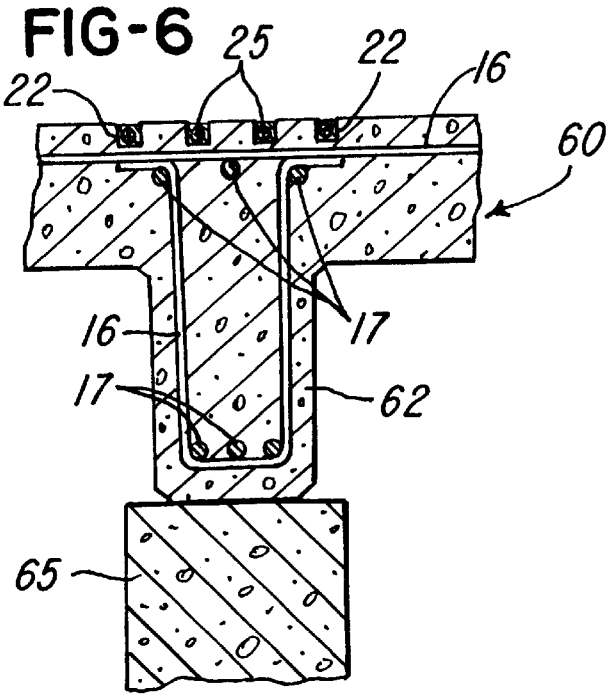
FIG. 6 is a fragmentary section similar to FIG. 4 and illustrating the strengthening of an existing reinforced beam supported by a column or girder.

FIG. 6 illustrates the method of the invention as applied to a poured concrete slab 60 having an integrally cast beam 62 and reinforced by embedded steel reinforcing rods 16 and 17. When a slab or an integral beam 62 is supported by a post or girder or column 65 and the embedded reinforcing steel 16 and/or 17 in the slab and/or beam is inadequate to provide the necessary or desired tensile strength, a series of parallel spaced grooves 22 are cut within the top surface of the concrete slab 60 in parallel spaced relation. The grooves extend over the support column 65 and preferably at least twenty percent of the distance to the next adjacent support. Each of the grooves 22 is filled with a supplemental composite fiber reinforcing element or rod 25 and a polymer adhesive resin such as the epoxy resin 28, as described above in connection with FIG. 2. The grooves 22, rods 25 and resin 28 may also be installed in the top surface of a concrete beam over a support when the beam requires strengthening.

As mentioned above, the supplemental composite fiber reinforcing elements or rods 25 may be pre-stressed before the polymer adhesive resin or epoxy resin 28 cures. It is also within the scope of the invention to deflect a concrete member in a direction opposite to the direction caused by loading and prior to curing of the polymer adhesive resin or epoxy resin 28. This locks in an initial pre-stress within each fibrous reinforcing element or rod 25. For example, a hydraulic jack may be used to press upwardly on the concrete slab 10 (FIG. 1) midway between the beams 12 in order to deflect the slab upwardly by a slight amount before the epoxy resin 28 cures and hardens within the grooves 22 which extend within the top surface of the slab 10.

The method of strengthening a previously cast reinforced concrete member of an existing structure at the structure site in accordance with the invention, provides desirable advantages. More specifically, by cutting each shallow groove 22 and selecting the corresponding fiber reinforcing element or rod 25 so that the rod substantially fills the groove and is positioned just under or adjacent the surface of the concrete member, the depth of the cut is minimized and the thickness of the polymer adhesive resin between the rod and the surfaces defining a groove is minimized. Thus the resin transfers the load by shear between the rod and the concrete, and the load is not transferred by a compressive wedging action as produced by a deformed steel rebar confined in concrete or mortar and which creates a splitting stress in the concrete. As a result, the method of the invention provides significantly greater strengthening of the concrete member over the use of steel rebars within concrete or mortar and also eliminates the long cure time required by concrete or mortar. In addition, since each composite fiber reinforcing element or rod and the adhesive resin do not present a corrosion problem, the groove is shallow so that the fiber reinforcing element or rod is located close to or adjacent the concrete surface where the element is the most effective and efficient in strengthening the concrete member.

While the method steps herein described constitute preferred embodiments of the invention, it is to be understood that the invention is not limited to these precise method steps, and that changes may be made therein without departing from the scope and spirit of the invention as defined in the appended claims. For example, it is not essential that each composite fiber reinforcing element be circular in cross-section, but may be square, oval or rectangular.

The invention having thus been described, the following is claimed:

1. A method of strengthening a previously cast reinforced concrete support member of an existing structure at the structure site, the concrete member having existing generally parallel elongated steel tensile reinforcing elements embedded below a surface of the concrete member in a direction of bending when the concrete member was previously cast, the method comprising the steps of cutting an elongated groove within the surface of the concrete member at a substantially uniform depth and in generally parallel spaced relation to the precast steel reinforcing elements, inserting a curable polymer adhesive resin into the groove for a substantial length of the groove, extending an elongated composite fiber reinforcing element within the adhesive resin in the groove with the fiber reinforcing element filling a substantial portion of the groove and with the adhesive resin filling the groove between the concrete and the fiber reinforcing element, and allowing the adhesive resin to cure for rigidly bonding the fiber reinforcing element along its length to the concrete defining the groove for supplementing tensile strength provided by the precast steel reinforcing elements.

2. A method as defined in claim 1 wherein the groove and reinforcing element extend within a top surface of a generally horizontal support member.

3. A method as defined in claim 1 wherein the groove and reinforcing element extend within a bottom surface of a generally horizontal concrete slab forming the support member and between adjacent supports for the slab.

4. A method as defined in claim 1 wherein the groove and reinforcing element extend longitudinally within a bottom surface of an elongated concrete beam forming the support member.

5. A method as defined in claim 1 wherein the groove and reinforcing element extend within a vertical surface of a modular masonry wall forming the support member and across joints within the masonry wall.

6. A method as defined in claim 1 wherein the elongated fiber reinforcing element occupies at least eighty percent of the width of the groove and includes longitudinally extending carbon fibers.

7. A method as defined in claim 1 and including the step of deflecting the support member in a direction opposite to a deflection caused by loading the support member and prior to allowing the resin to cure to obtain an initial pre-stress in the reinforcing element.

8. A method of strengthening a previously cast reinforced concrete support member of an existing structure at the structure site, the concrete member having existing generally parallel elongated steel tensile reinforcing elements embedded below a surface of the concrete member in a direction of bending when the concrete member was previously cast, the method comprising the steps of cutting a plurality of generally parallel spaced elongated grooves within the surface of the concrete member at a substantially uniform depth and in generally parallel spaced relation to the precast steel reinforcing elements, inserting a curable polymer adhesive resin into each groove for a substantial length of each groove, extending an elongated composite fiber reinforcing element within the adhesive resin in each groove with the fiber reinforcing element filling a substantial portion of each groove and with the adhesive resin filling each groove between the concrete and each fiber reinforcing element, and allowing the adhesive resin to cure for rigidly bonding each fiber reinforcing element along its length to the concrete defining each corresponding groove for supplementing tensile strength provided by the precast steel reinforcing elements.

9. A method as defined in claim 8 wherein the grooves and corresponding reinforcing elements extend within a top surface of a generally horizontal support member.

10. A method as defined in claim 8 wherein the grooves and corresponding reinforcing elements extend within a bottom surface of a generally horizontal concrete slab forming the support member and between adjacent supports for the slab.

11. A method as defined in claim 8 wherein the grooves and corresponding reinforcing elements extend longitudinally within a bottom surface of an elongated concrete beam forming the support member.

12. A method as defined in claim 8 wherein the grooves and corresponding reinforcing elements extend within a vertical surface of a modular masonry wall forming the support member and across joints within the masonry wall.

13. A method as defined in claim 8 wherein each fiber reinforcing element occupies at least eighty percent of the width of the corresponding groove.

14. A method as defined in claim 8 and including the step of deflecting the support member in a direction opposite to a deflection caused by loading the support member and prior to allowing the resin to cure to obtain an initial pre-stress in the reinforcing elements.

15. A method of strengthening a previously cast horizontal reinforced concrete slab of an existing structure at the structure site, the concrete slab having existing generally parallel elongated steel tensile reinforcing elements embedded below a top surface of the concrete member in a direction of bending when the concrete member was previously cast, the method comprising the steps of cutting a plurality of generally parallel spaced elongated grooves within the top surface of the concrete slab and over a support for the slab with the grooves at a substantially uniform depth and in generally parallel spaced relation to the precast steel reinforcing elements, inserting a curable polymer adhesive resin into each groove for a substantial length of each groove, extending an elongated composite fiber reinforcing element within the adhesive resin in each groove with the fiber reinforcing element filling a substantial portion of each groove and with the adhesive resin filling each groove between the concrete and each fiber reinforcing element, and allowing the adhesive resin to cure for rigidly bonding each fiber reinforcing element along its length to the concrete defining each corresponding groove for supplementing tensile strength provided by the precast steel reinforcing elements.

* * * * *